US006931877B2

(12) United States Patent
Kasuya et al.

(10) Patent No.: US 6,931,877 B2
(45) Date of Patent: Aug. 23, 2005

(54) REFRIGERATING OPEN SHOWCASE

(75) Inventors: Junichiro Kasuya, Isesaki (JP); Takahiro Takei, Takasaki (JP)

(73) Assignee: Sanden Corp., Gunma (JP)

( * ) Notice: Subject to any disclaimer, the term of this patent is extended or adjusted under 35 U.S.C. 154(b) by 0 days.

(21) Appl. No.: 10/443,066

(22) Filed: May 22, 2003

(65) Prior Publication Data

US 2003/0217560 A1 Nov. 27, 2003

(30) Foreign Application Priority Data

May 22, 2002 (JP) ..... 2002-147659
Mar. 26, 2003 (JP) ..... 2003-085905

(51) Int. Cl.[7] ..... A47F 3/04
(52) U.S. Cl. ..... 62/256; 454/193
(58) Field of Search ..... 62/255, 256; 454/193

(56) References Cited

U.S. PATENT DOCUMENTS 2,810,267 A * 10/1957 Reuter et al. ..... 62/256
2,955,438 A * 10/1960 Thompson ..... 62/256
2,967,404 A * 1/1961 Detwiler ..... 62/256
3,324,783 A * 6/1967 Hickox ..... 454/193
4,120,174 A * 10/1978 Johnston ..... 62/256
4,300,358 A * 11/1981 Hino et al. ..... 62/256
4,302,948 A * 12/1981 Ibrahim et al. ..... 62/256
4,338,792 A * 7/1982 Ibrahim ..... 62/256
4,449,374 A * 5/1984 Ibrahim ..... 62/81

FOREIGN PATENT DOCUMENTS

JP 59-028304 2/1984
JP 63-017978 1/1988
JP 06-003030 1/1994

* cited by examiner

*Primary Examiner*—William E. Tapolcai
(74) *Attorney, Agent, or Firm*—Banner & Witcoff, Ltd.

(57) ABSTRACT

In a refrigerating open showcase comprising a showcase body whose top surface is open; an inner plate disposed to form an air passage between the inner plate and the showcase body; and a cooler disposed in the air passage, in which an air curtain is formed on the top surface of the showcase body by causing air having been cooled in the air passage to flow from a discharge port to a suction port, the upper end of the inner plate on the suction port side is bent toward the air passage on the suction side, and the upper face of the bent portion is inclined slightly with respect to the horizontal in the direction that the upper face of said bent portion faces a side wall on the suction port side of the showcase body.

5 Claims, 8 Drawing Sheets

(A) SECTIONAL VIEW (B) VIEW TAKEN FROM COMMODITY STORAGE PORTION SIDE (A) SECTIONAL VIEW (B) VIEW TAKEN FROM COMMODITY STORAGE PORTION SIDE

REFRIGERATING OPEN SHOWCASE

BACKGROUND OF THE INVENTION

1. Field of the Invention

The present invention relates to a flat type refrigerating open showcase whose top surface is open and, more particularly, to a technology for forming an air curtain therefor.

2. Description of the Related Art

A conventional refrigerating open showcase of this type will be described with reference to FIG. 9. FIG. 9 is a sectional view of a conventional refrigerating open showcase.

As shown in FIG. 9, a refrigerating open showcase 1 includes a heat insulating showcase body 2 whose top surface is open, an inner plate 3 erecting along a side wall 2*a* of the showcase body 2, and a bottom plate 4 for closing the lower part of the inner plate 3. The upper end of the side wall 2*a* of the showcase body 2 projects to the inside. The upper end of the inner plate 3 is positioned under a projecting portion 2*b* of the side wall 2*a*. Thereby, an air passage 5 is formed by a gap between the side wall 2*a* of the showcase body 2 and the inner plate 3 and a gap between a bottom plate 2*c* of the showcase body 2 and the bottom plate 4. In the air passage 5, a cooler 6 and a fan 7 are provided. On the discharge port 8 side of the air passage 5, a straightening element 9 is disposed.

With this construction, when the cooler 6 and the fan 7 are operated, cold air having been cooled by the cooler 6 is discharged through a discharge port 8, and the cold air is sucked through a suction port 10. Thus, what is called an air curtain is formed over a range from the discharge port 8 to the suction port 10 on the top surface of the showcase body 2. Thereby, commodities stored in a commodity storage portion 11 can be cooled.

In the above-described conventional refrigerating open showcase, as shown in an enlarged view of FIG. 10, the upper end of the inner plate 3 on the suction port 10 side is bent toward the commodity storage portion 11. Also, as a conventional refrigerating open showcase 1 of another type, a refrigerating open showcase in which the upper end of the inner plate 3 on the suction port 10 side is bent toward the side wall 2*a* of the showcase body 2, as shown in an enlarged view of FIG. 11, is known. Both of these bent portions 3*e* are provided to increase the strength of the inner plate 3. In the above-described refrigerating open showcase 1, however, since the flow velocity of cold air in the vicinity of the suction port 10 is lower than that in the vicinity of the discharge port 8, the commodities stored near the suction port 10 are sometimes cooled insufficiently. Also, commodities sometimes drop into the air passage 5 through the suction port 10.

As a conventional refrigerating open showcase 1 of still another type, a refrigerating open showcase in which a guard 12 for preventing commodities from dropping is provided in a range from the projecting portion 2*b* of the side wall 2*a* to the air passage 5, as shown in FIG. 12(A), is known. In the guard 12, vent holes 12*a* are formed by punching as shown in FIG. 12(B). On the air passage 5 side of the guard 12, heaters 13 for preventing frosting are provided. However, such a refrigerating open showcase 1 has a problem of increased cost because it requires the guard 12 and the heater 13. Also, it has a problem of increased power consumption caused by the driving of the heater 13.

As a refrigerating open showcase of a type similar to the refrigerating open showcase 1 shown in FIG. 12, a refrigerating open showcase in which the upper part of the inner plate 3 is bent slantwise and the upper end thereof is attached to the side wall 2*a*, and vent holes 3*d* are formed in the inclined portion, as shown in FIG. 13, is known. On the back side of the inclined portion, the heaters 13 for preventing frosting are provided. Although such a refrigerating open showcase 1 has an advantage that the number of parts decreases as compared with the refrigerating open showcase shown in FIG. 12, it still has a problem of increased power consumption caused by the driving of the heater 13.

In the conventional refrigerating open showcase 1, as shown in an enlarged view of an essential portion of FIG. 14, the upper end of the inner plate 3 on the discharge port 8 side is bent substantially horizontally toward the commodity storage portion 11. Also, the straightening element 9 disposed in the discharge port 8 is made up of a plurality of straightening vanes 9*a* to 9*c* which are formed along the air passage 5 and arranged at predetermined intervals. The intervals of the straightening vanes 9*a* to 9*c* are adjusted so that the flow velocities of cold air discharged from between the straightening vanes 9*a* to 9*c* differ from each other. Specifically, the intervals are adjusted so that the flow velocity increases from the upper layer toward the lower layer. In FIG. 14, the flow velocity and direction of each layer are indicated by the length and direction of an arrow mark. In such a construction, however, since the flow velocity of the lowermost layer which is closest to the commodities stored in the commodity storage portion 11 is highest, cold air of this lowermost layer hits the commodities, and hence there is a fear that great turbulence occurs in the air curtain. Therefore, there may arise a problem in that the outside air intrudes into the commodity storage portion 11, which decreases the cooling efficiency.

SUMMARY OF THE INVENTION

An object of the present invention is to provide a refrigerating open showcase whose cooling efficiency is high and whose manufacturing cost and running cost are low.

To achieve the above object, the present invention provides a refrigerating open showcase comprising a showcase body whose top surface is open; an inner plate disposed inside the showcase body to form an air passage between the inner plate and the showcase body; and a cooler disposed in the air passage, in which an air curtain is formed on the top surface of the showcase body by causing air having been cooled in the air passage to flow from the upper end on one side of the showcase body to the upper end on the other side thereof, wherein the upper end of the inner plate facing one side on the cold air suction side of the showcase body is bent toward the air passage on the suction side, and the upper face of the bent portion is inclined slightly with respect to the horizontal in the direction that the upper face of the bent portion faces the one side of the showcase body.

According to the present invention, since the upper end of the inner plate on the suction port side is bent toward the air passage on the suction side, and is inclined slightly with respect to the horizontal in the direction that the upper face of the bent potion faces the one side of the showcase body, that is, into the the air passage, cold air in the vicinity of the suction port is introduced into the air passage without decrease in flow velocity by a throttling effect due to a decrease in area of the suction port and an effect of guiding cold air into the air passage. Thereby, the cold of commodities stored in the vicinity of the suction port is prevented from decreasing. Also, since the area of suction port decreases, the commodities can be prevented from dropping. Further, since the upper face of this bent portion is slightly inclined into the air passage, even if frost adheres to the upper part of the inner plate, defrosting water having been melted during the defrosting time does not flow out to the commodity storage portion side. Therefore, a heater need not be provided on the inner plate, so that the manufacturing cost and running cost can be reduced.

Also, the present invention provides a refrigerating open showcase comprising a showcase body whose top surface is open; an inner plate disposed on the inside of the showcase body to form an air passage between the inner plate and the showcase body; and a cooler disposed in the air passage, in which an air curtain is formed on the top surface of the showcase body by causing air having been cooled in the air passage to flow from the upper end on one side of the showcase body to the upper end on the other side thereof, wherein the upper end of the inner plate facing one side on the cold air discharge side of the showcase body is bent toward the air passage on the discharge side.

According to the present invention, since the upper end of the inner plate at the lower end of the discharge port is bent toward the air passage on the discharge side, the flow velocity of cold air discharged from the lowermost layer of discharge port can be restrained. Thereby, a proper air curtain can be formed, so that the cooling effect is improved.

The objects, configurations, and effects of the present invention other than those described above will be apparent from the ensuing detailed description.

DESCRIPTION OF THE PREFERRED EMBODIMENTS

Figure 1:
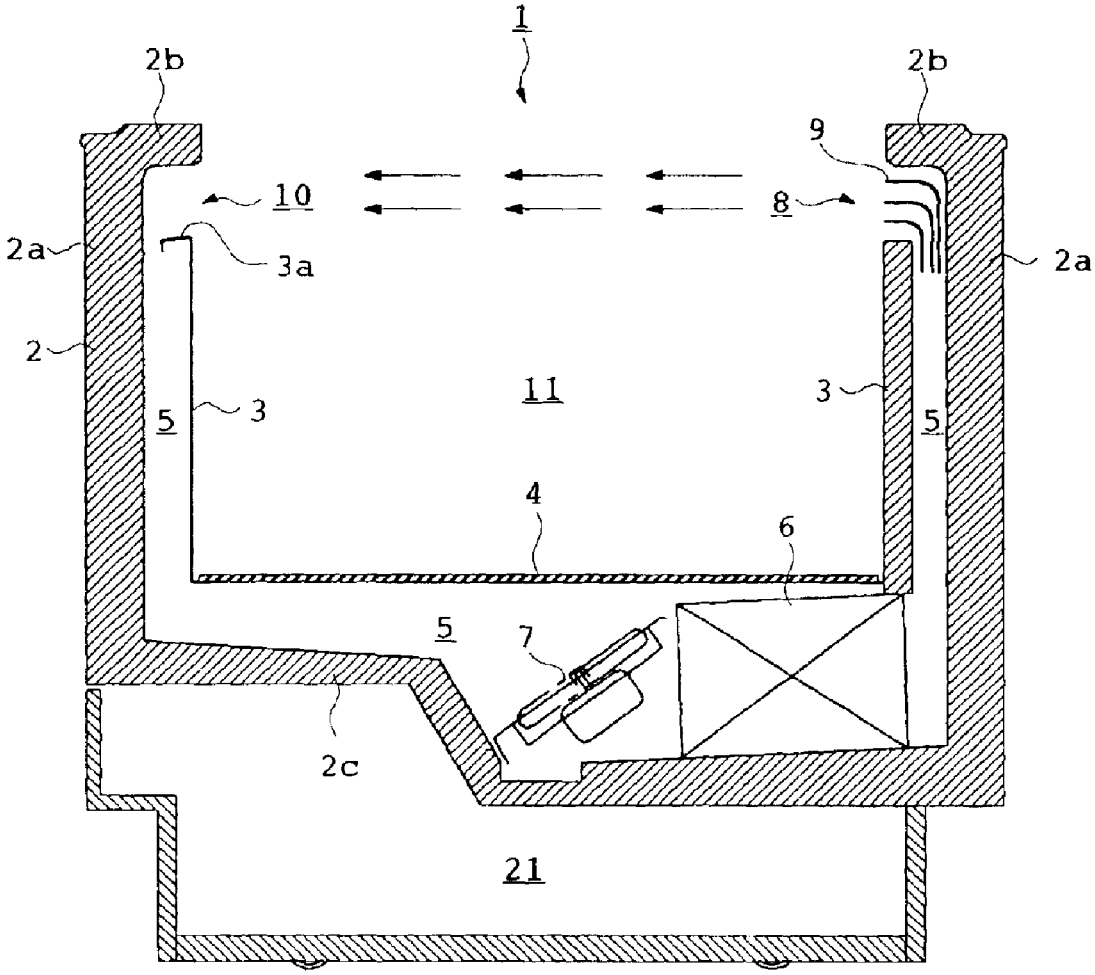
FIG. 1 is a sectional view of a refrigerating open showcase.
Figure 9:
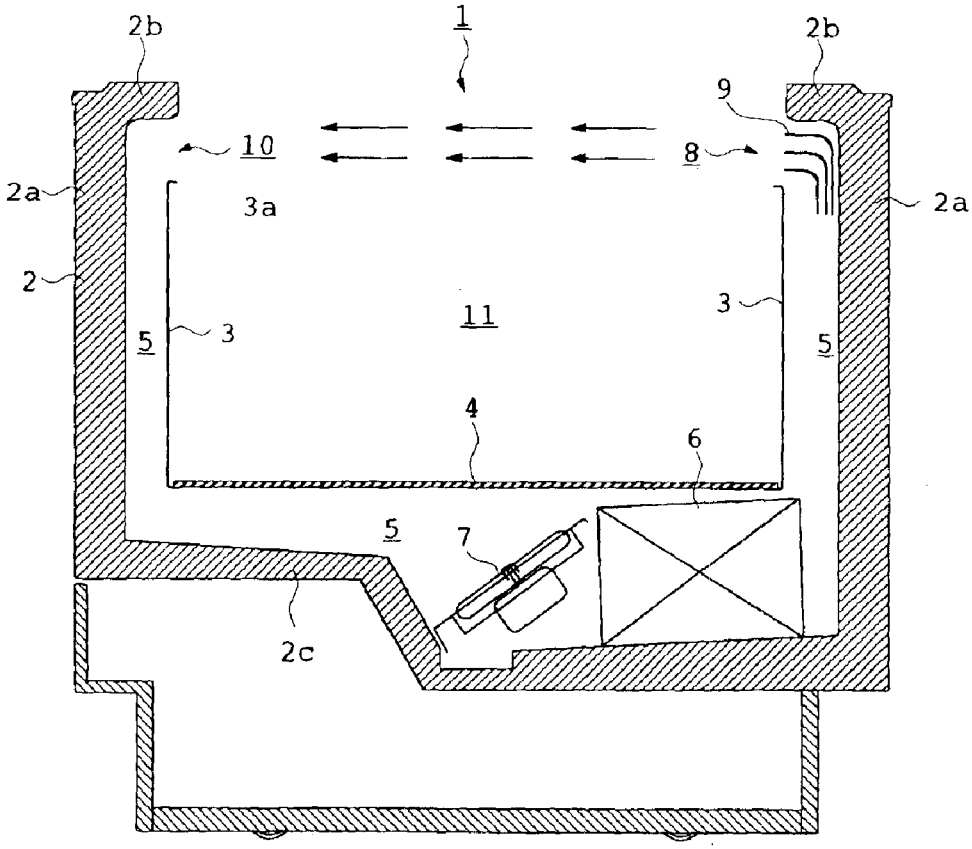
FIG. 9 is a sectional view of a conventional refrigerating open showcase.
Figure 10:
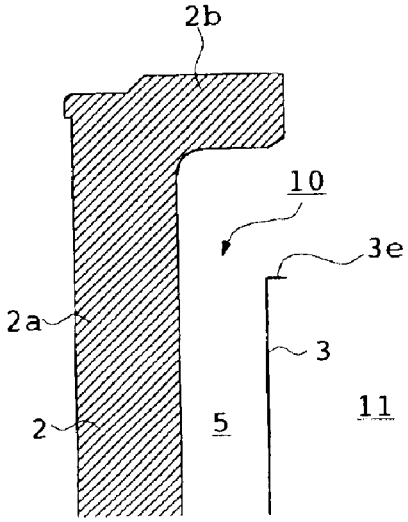
FIG. 10 is an enlarged sectional view of an essential portion of a conventional refrigerating open showcase.
Figure 11:
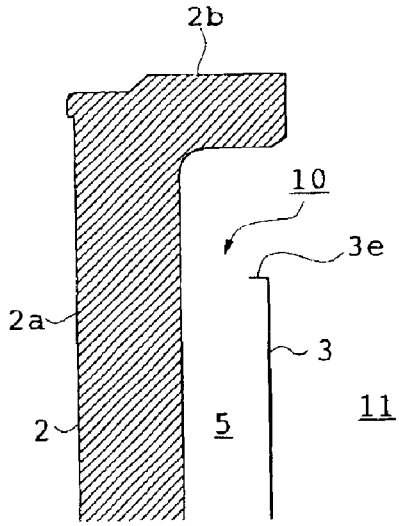
FIG. 11 is an enlarged sectional view of an essential portion of a conventional refrigerating open showcase.
Figure 12:
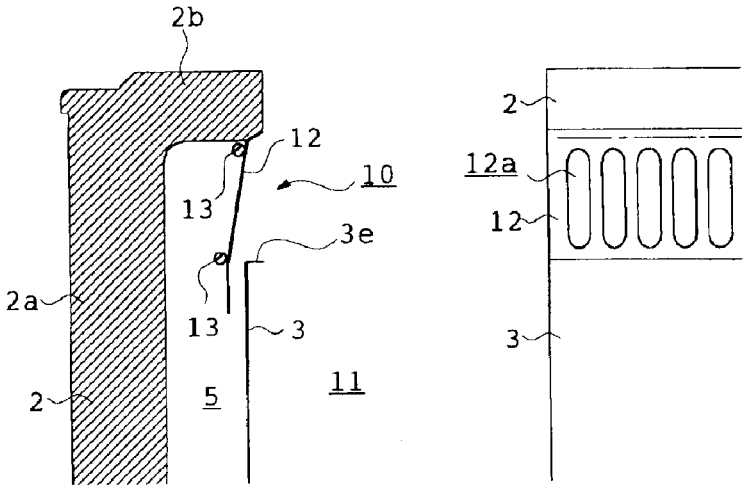
FIG. 12(A) is an enlarged sectional view of an essential portion of a conventional refrigerating open showcase.
FIG. 12(B) is a front view of a suction port, which is viewed from the commodity storage portion side.
Figure 13:
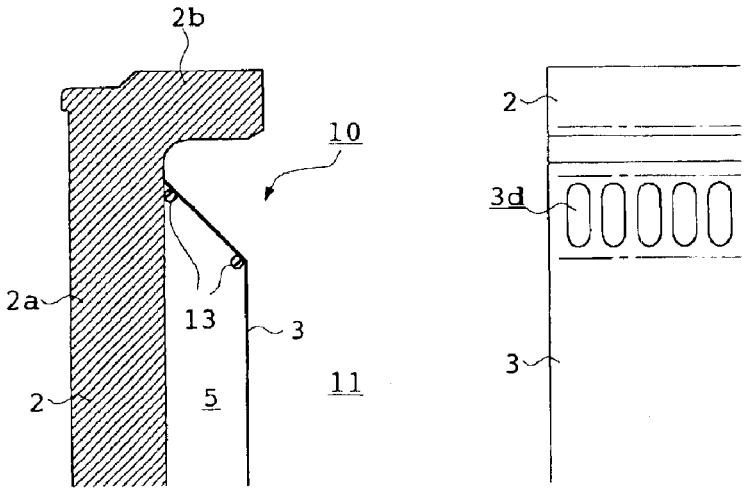
FIG. 13(A) is an enlarged sectional view of an essential portion of a conventional refrigerating open showcase.
FIG. 13(B) is a front view of a suction port, which is viewed from the commodity storage portion side.
Figure 14:
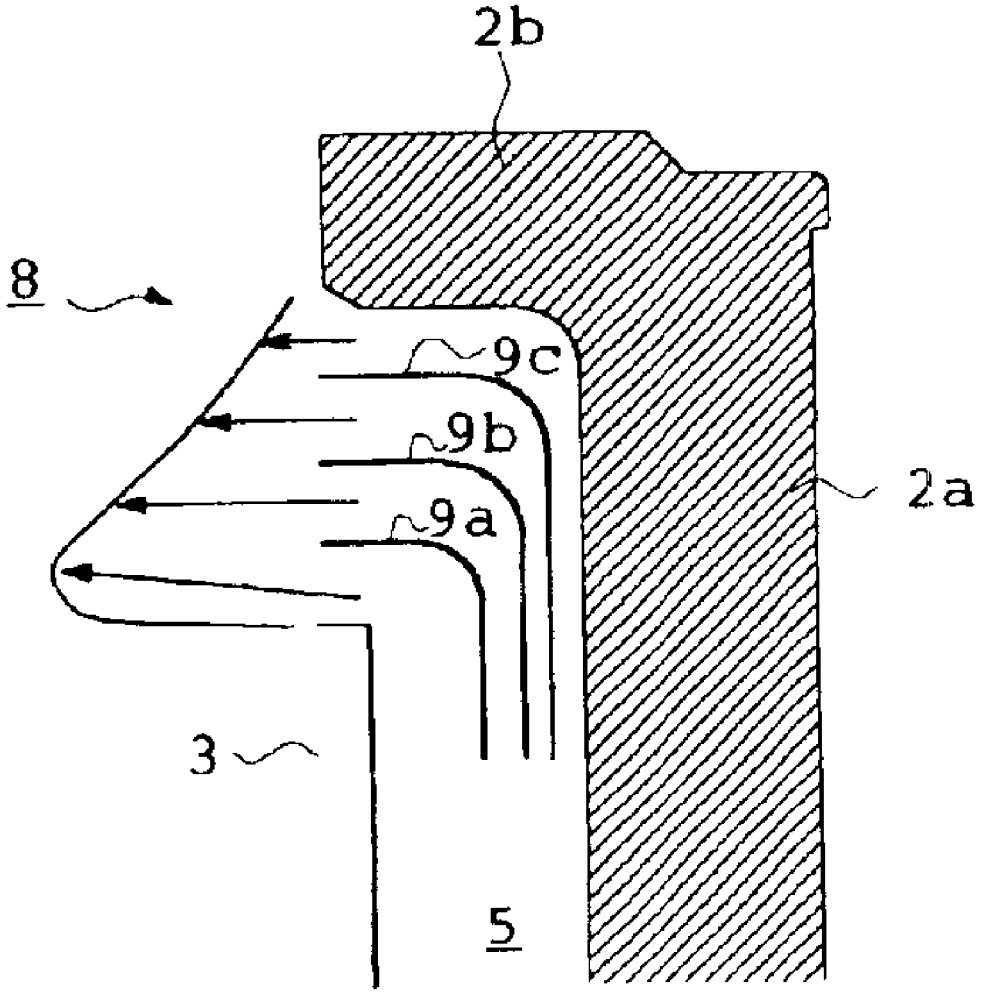
FIG. 14 is an enlarged sectional view of an essential portion of a conventional refrigerating open showcase.

A refrigerating open showcase in accordance with one embodiment of the present invention will be described with reference to FIG. 1. FIG. 1 is a sectional view of a refrigerating open showcase in accordance with this embodiment. In FIG. 1, the same reference numerals are applied to the elements as those of the conventional refrigerating open showcase described above with reference to FIG. 9.

As shown in FIG. 1, a refrigerating open showcase 1 includes a heat insulating showcase body 2 substantially having a box shape whose top surface is open, an inner plate 3 erecting along a side wall 2*a* of the showcase body 2, and a bottom plate 4 for closing the lower part of the inner plate 3. The upper end of the side wall 2*a* of the showcase body 2 projects to the inside. The upper end of the inner plate 3 is positioned under a projecting portion 2*b* of the side wall 2*a*. Thereby, an air passage 5 is formed by a gap between the side wall 2*a* of the showcase body 2 and the inner plate 3 and a gap between a bottom portion 2*c* of the showcase body 2 and the bottom plate 4. In the air passage 5, a cooler 6 and a fan 7 are provided. On the discharge port 8 side of the air passage 5, a straightening element 9 is disposed.

Under this showcase body 2 a machinery chamber 21 is formed. The machinery chamber 21 contains equipment (not shown) forming a refrigerating cycle, such as a compressor and a condenser, which is connected to the cooler 6.

With this construction, when the cooler 6 and the fan 7 are operated, cold air having been cooled by the cooler 6 is discharged through a discharge port 8, and the cold air is sucked through a suction port 10. Thus, what is called an air curtain is formed over a range from the discharge port 8 to the suction port 10 on the top surface of the showcase body 2. Thereby, commodities stored in a commodity storage portion 11 can be cooled.

Figure 2:
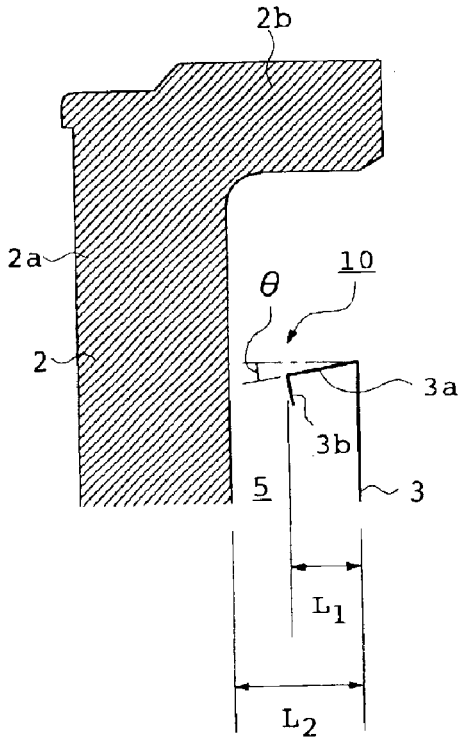
FIG. 2 is an enlarged sectional view of an essential portion of a refrigerating open showcase.

The first feature of the refrigerating open showcase in accordance with this embodiment is the upper end construction of the inner plate 3 on the suction port 10 side. This first feature will be described with reference to FIG. 2. FIG. 2 is an enlarged sectional view of an essential portion of the refrigerating open showcase.

As shown in FIG. 2, the inner plate 3 on the suction port 10 side has the first bent portion 3*a* that is formed by bending the upper end portion of the inner plate 3 toward the air passage 5. Further, the inner plate 3 has the second bent portion 3*b* that is formed by bending the edge portion of the first bent portion 3*a* downward. The upper face of the first bent portion 3*a* is slightly inclined with respect to the horizontal into the air passage 5. The inclination angle 0 of the first bent portion 3*a* with respect to the horizontal is preferably not smaller than 2° and not larger than 10°. In this embodiment, the inclination angle is set at 5°. By providing this inclination angle, defrosting water can be drained properly, and also a proper effect of guiding cold air into the air passage can be achieved. Also, the length L1 of the first bent portion 3*a* is approximately a half of the width L2 of the air passage in FIG. 2. Thereby, the optimum throttling effect in the vicinity of the suction port 10 can be achieved.

Figure 3:
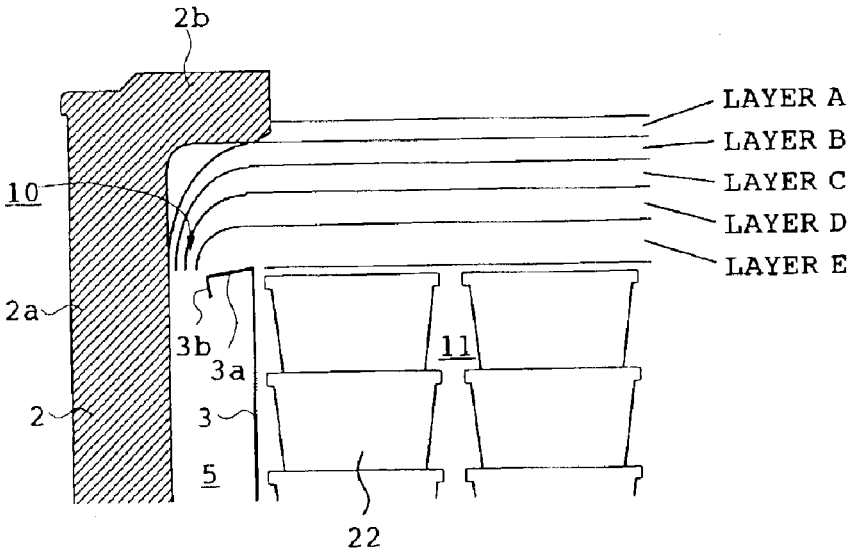
FIG. 3 is an enlarged sectional view of an essential portion, illustrating a state in which an air curtain is formed in a refrigerating open showcase.
Figure 4:
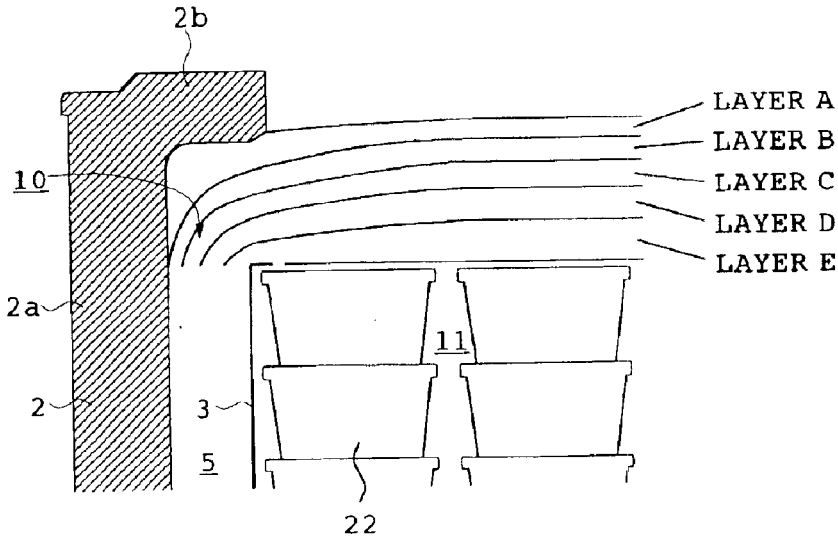
FIG. 4 is an enlarged sectional view of an essential portion, illustrating a state in which an air curtain is formed in a conventional refrigerating open showcase.

A difference in cooling capability between the refrigerating open showcase of this embodiment and the conventional refrigerating open showcase is explained by comparing FIGS. 3 and 4 with each other. FIG. 3 is an enlarged sectional view of an essential portion, illustrating the state in which an air curtain is formed in the refrigerating open showcase in accordance with this embodiment, and FIG. 4 is an enlarged sectional view of an essential portion, illustrating the state in which an air curtain is formed in the conventional refrigerating open showcase.

FIGS. 3 and 4 show a state of formation of an air curtain in the vicinity of the suction port 10 in the case where commodities 22 are stored to the height of the inner plate 3 in the commodity storage portion 11. Concretely, the temperature of air curtain was observed using thermography, and the temperature regions of layer A to layer E were indicated in the figures. The temperature width of each layer is 4° C., and the temperature in the temperature region of layer A is higher than the temperature in the temperature range of layer E.

It is apparent from FIGS. 3 and 4 that in the conventional refrigerating open showcase, the width of each layer decreases toward the inner plate 3, while in the refrigerating open showcase in accordance with this embodiment, the layers are formed uniformly up to a high position above the inner plate 3. Specifically, the figures reveal that in the vicinity of the inner plate 3, the width of layer A to layer E in the refrigerating open showcase 1 in accordance with this embodiment is greater than that in the conventional refrigerating open showcase, and hence the cooling capability in this portion is higher. The reason for this is thought to be that the flow velocity is increased by (1) the effect of guiding cold air into the air passage 5, and (2) the throttling effect due to a decrease in opening area of the suction port 10, which are achieved by the first bent portion 3*a* and its inclination.

Figure 5:
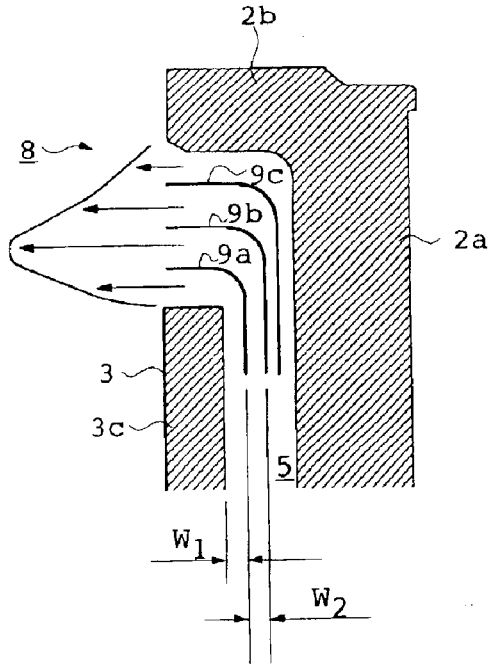
FIG. 5 is an enlarged sectional view of an essential portion of a refrigerating open showcase.

The second feature of the refrigerating open showcase in accordance with this embodiment is the construction of the discharge port 8. This second feature will be described with reference to FIG. 5. FIG. 5 is an enlarged sectional view of an essential portion of the refrigerating open showcase.

As shown in FIG. 5, the upper end of the inner plate 3 on the discharge port 8 side is bent toward the air passage 5 side. Also, on the air passage side of the inner plate 3 a heat insulating material 3*c* is provided. The straightening element 9 disposed in the discharge port 8 is made up of a plurality of straightening vanes 9*a* to 9*c* which are formed along the air passage 5 and arranged at predetermined intervals. The intervals of the straightening vanes 9*a* to 9*c* are adjusted so that the flow velocities of cold air discharged from between the straightening vanes 9*a* to 9*c* differ from each other. Specifically, the flow velocity of the layer just above the lowermost layer is the highest, and the flow velocity decreases from that layer toward the upper layer or lower layer. In FIG. 5, the flow velocity and direction of each layer are indicated by the length and direction of an arrow mark. In order to realize such a layer construction, the distance between vanes is adjusted so that W1<W2, where W1 is the distance between the straightening vane 9*a* and the end of the inner plate 3 in the air passage 5, and W2 is the distance between the straightening vane 9*a* and the straightening vane 9*b* in the air passage 5. Thereby, the flow velocity of the lowermost layer closest to the commodities stored in the commodity storage portion 11 is restrained, and hence the collision of cold air with the commodities is restrained. Therefore, an air curtain is formed without turbulence, so that a decrease in cooling efficiency due to the intrusion of the outside air can be prevented.

As described above, in the refrigerating open showcase 1 in accordance with this embodiment, since the upper end of the inner plate 3 on the suction port 10 side is bent toward the air passage 5 on the suction side, and is inclined into the air passage 5, cold air in the vicinity of the suction port 10 is introduced into the air passage 5 without decrease in flow velocity by the throttling effect due to a decrease in area of the suction port and the effect of guiding cold air into the air passage 5. Thereby, the cold of commodities stored in the vicinity of the suction port 10 is prevented from decreasing. In other words, uniform cooling capability is provided in the whole of the commodity storage portion 11.

Also, since the opening area of the suction port 10 is decreased by the first bent portion 3*a* of the inner plate 3, the commodities can be prevented from dropping into the air passage 5.

Further, since the upper face of the first bent portion 3*a* is slightly inclined with respect to the horizontal into the air passage 5, even if frost adheres to the upper part of the inner plate 3, defrosting water having been melted during the defrosting time does not flow out to the commodity storage portion side, but flows out to the air passage 5 side. Therefore, a heater need not be provided on the inner plate 3, so that the manufacturing cost and running cost can be reduced.

Further, since the upper end of the inner plate on the discharge port 8 side is bent toward the air passage 5 on the discharge port 8 side, an air curtain without turbulence can be formed. Thereby, a decrease in cooling efficiency due to the intrusion of the outside air can be prevented.

The above is a detailed description of one embodiment of the present invention. The present invention is not limited to the above-described embodiment. The scope of the present invention is defined by the claims, and all modifications included in the meaning of each claim are embraced in the present invention.

Figure 6:
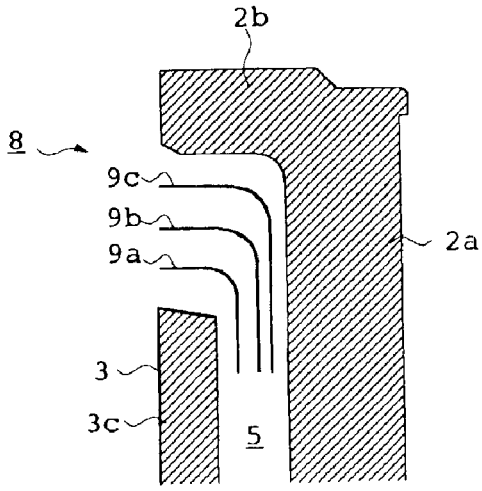
FIG. 6 is an enlarged sectional view of an essential portion of a refrigerating open showcase in accordance with another example.
Figure 7:
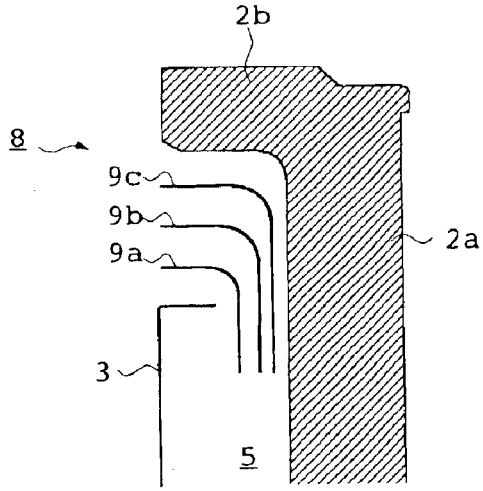
FIG. 7 is an enlarged sectional view of an essential portion of a refrigerating open showcase in accordance with another example.
Figure 8:
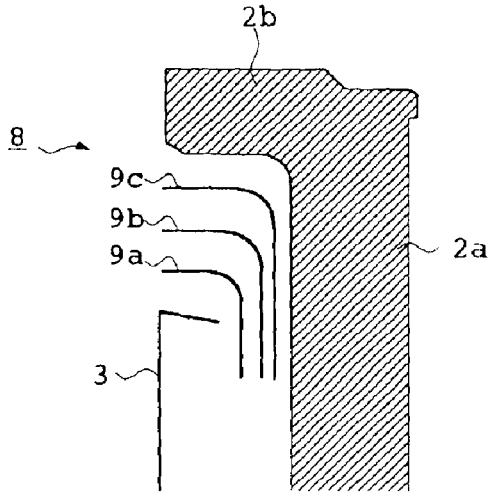
FIG. 8 is an enlarged sectional view of an essential portion of a refrigerating open showcase in accordance with another example.

For example, although the upper end of the inner plate 3 on the discharge port 8 side is bent substantially horizontally in the above-described embodiment, it may be bent so that the end lowers slightly as shown in FIG. 6. Also, as shown in FIGS. 7 and 8, the configuration may be such that no heat insulating material is provided on the air passage 5 side of the inner plate 3.

What is claimed is:

1. A refrigerating open showcase comprising a showcase body whose top surface is open; an inner plate disposed on the inside of said showcase body to form an air passage between said inner plate and said showcase body; and a cooler disposed in said air passage, in which an air curtain is formed on the top surface of said showcase body by causing air having been cooled in said air passage to flow from the upper end on one side of said showcase body to the upper end on the other side thereof, wherein the upper end of the inner plate facing one side on the cold air suction side of said showcase body includes a bent portion that is bent toward said air passage on the suction side, and said bent portion is slightly inclined with regard to the horizontal in the direction that the upper face of said bent portion faces said one side of said showcase body, a length of said bent portion is approximately a half of a distance between said showcase body and said inner plate constituting said air passage on the suction side, and a tip end of said bent portion is bent downward.

2. A refrigerating open showcase comprising a showcase body whose top surface is open; an inner plate disposed on the inside of said showcase body to form an air passage between said inner plate and said showcase body and also form a wall for a commodity holding area of said showcase; and a cooler disposed in said air passage, in which an air curtain is formed on the top surface of said showcase body by causing air having been cooled in said air passage to flow from the upper end on one side of said showcase body to the upper end on the other side thereof, wherein the upper end of the inner plate facing one side on the cold air discharge side of said showcase body includes a bent portion that is bent toward said air passage on the discharge side, and insulation is positioned under the bent portion on the discharge side.

3. The refrigerating open showcase recited in claim 2, wherein the refrigerating open showcase includes at least a first vane and a second vane that each include a downwardly extending portion positioned in said air passage on the discharge side, said downwardly extending portion of said first vane being positioned a first distance from an end of the bent portion, and said downwardly extending portion of said second vane being positioned a second distance from said first vane, the first distance being less than the second distance.

4. A refrigerating open showcase comprising a showcase body whose top surface is open; an inner plate disposed on the inside of said showcase body to form an air passage between said inner plate and said showcase body and also form a wall for a commodity holding area of said showcase; and a cooler disposed in said air passage, in which an air curtain is formed on the top surface of said showcase body by causing air having been cooled in said air passage to flow from the upper end on one side of said showcase body to the upper end on the other side thereof, wherein the upper end of the inner plate facing one side on the cold air suction side of said showcase body is bent toward said air passage on the suction side, and said bent portion is inclined slightly with respect to the horizontal in the direction that the upper face of said bent portion faces said one side of said showcase body, and the upper end of the inner plate facing one side on the cold air discharge side of said showcase body includes a bent portion that is bent toward said air passage on the discharge side, and insulation is positioned under the bent portion on the discharge side.

5. The refrigerating open showcase recited in claim 4, wherein the refrigerating open showcase includes at least a first vane and a second vane that each include a downwardly extending portion positioned in said air passage on the discharge side, said downwardly extending portion of said first vane being positioned a first distance from an end of the bent portion, and said downwardly extending portion of said second vane being positioned a second distance from said first vane, the first distance being less than the second distance.

* * * * *